US005691700A

United States Patent [19]

Phelps et al.

[11] Patent Number: 5,691,700

[45] Date of Patent: Nov. 25, 1997

[54] APPARATUS AND METHOD USING NON-CONTACT LIGHT SENSING WITH SELECTIVE FIELD OF VIEW, LOW INPUT IMPEDANCE, CURRENT-MODE AMPLIFICATION AND/OR ADJUSTABLE SWITCHING LEVEL

[75] Inventors: Stephen K. Phelps, South Windsor; Frederick T. Olender, Somers; Martin F. Zabielski, Manchester, all of Conn.

[73] Assignee: United Technologies Corporation, East Hartford, Conn.

[21] Appl. No.: 306,776

[22] Filed: Sep. 15, 1994

[51] Int. Cl.[6] ..... G08B 21/00

[52] U.S. Cl. ..... 340/600; 340/630; 250/554

[58] Field of Search ..... 340/600, 555, 340/556, 557, 632, 630; 250/339.15, 200, 554, 573

[56] References Cited

U.S. PATENT DOCUMENTS

| | | | |
|---|---|---|---|
| 3,689,773 | 9/1972 | Wheeler | 250/217 |
| 3,692,415 | 9/1972 | Shiller | 356/187 |
| 3,967,255 | 6/1976 | Oliver et al. | 250/554 |
| 4,039,844 | 8/1977 | MacDonald | 250/554 |
| 4,059,385 | 11/1977 | Gulitz et al. | 431/12 |
| 4,163,903 | 8/1979 | Robertson | 250/554 |
| 4,226,533 | 10/1980 | Snowman | 340/630 |
| 4,328,488 | 5/1982 | Yanai et al. | 340/578 |
| 4,391,517 | 7/1983 | Zucker et al. | 250/554 |
| 4,398,570 | 8/1983 | Suzuki et al. | 250/554 |
| 4,425,788 | 1/1984 | Franke et al. | 250/554 |
| 4,481,506 | 11/1984 | Honma | 340/630 |
| 4,533,834 | 8/1985 | McCormack | 250/554 |
| 4,555,800 | 11/1985 | Nishikawa et al. | 382/25 |
| 4,616,137 | 10/1986 | Goff et al. | 250/554 |
| 4,653,998 | 3/1987 | Sohma et al. | 431/79 |
| 4,695,734 | 9/1987 | Honma et al. | 340/630 |
| 4,778,378 | 10/1988 | Dolnick et al. | 431/79 |
| 4,906,178 | 3/1990 | Goldstein et al. | 431/79 |
| 4,913,647 | 4/1990 | Bonne et al. | 431/12 |
| 5,222,887 | 6/1993 | Zabielski, Sr. | 431/12 |
| 5,420,440 | 5/1995 | Ketler et al. | 340/630 |

*Primary Examiner*—Jeffery Hofsass
*Assistant Examiner*—Davetta Woods
*Attorney, Agent, or Firm*—Thomas, Kayden, Horstemeyer & Risley

[57] ABSTRACT

A light detection apparatus includes a light detector using a photoelectric converter such as a photodiode. The light detector has a selective viewport that limits the field of view observed by the photoelectric converter. The photoelectric converter generates a current signal based on the light received through the selective viewport. Using current-mode amplification, a current amplifier generates an amplified current signal based on the current signal received from the photoelectric converter. A switch coupled to receive the amplified current signal from the current amplifier, generates an output signal based on the amplified current signal. The switch can be implemented to generate the output signal with predetermined logic levels compatible with a desired logic family.

13 Claims, 4 Drawing Sheets

APPARATUS AND METHOD USING NON-CONTACT LIGHT SENSING WITH SELECTIVE FIELD OF VIEW, LOW INPUT IMPEDANCE, CURRENT-MODE AMPLIFICATION AND/OR ADJUSTABLE SWITCHING LEVEL

BACKGROUND OF THE INVENTION

1. Field of the Invention

The present invention is related to an apparatus and method for sensing light to generate an electric output signal indicative of the presence or absence of the light.

2. Description of the Related Art

To detect the presence or absence of a flame, gas furnace products typically use ionization flame sensors with support electronics. The ionization flame sensor is placed directly in the gas flame, where electrons emitted by combustion are available for sensing. Although the ionization flame sensor produces an acceptable signal for the control electronics, the sensor is relatively expensive and, under certain conditions, subject to failure. Of course, the failure to correctly sense the flame in a gas furnace, can lead to dangerous conditions, such as, for example, high gas vapor levels creating the potential for explosion, and endangering lives by asphyxiation. Also, the emission of unburned gas can lead to unnecessary pollution.

In place of ionization flame sensors, photosensors have been used for flame detection. Among other advantages, the photosensor is not in contact with the flame and so generally has less stringent durability requirements than an ionization flame sensor. However, a competing consideration is that photosensors tend to be temperature-dependent and subject to false flame indications caused by ambient light. Although a photosensor is generally selected to generate electric current based on a particular light wavelength(s) emitted during combustion, ambient light often includes the combustion wavelengths. Accordingly, optical filtering of light entering the photosensor to exclude wavelengths other than those emitted during combustion, does not significantly improve the reliability of a flame detector using a photosensor, and adds significantly to the expense of a photosensor using optical filtering.

One effective technique for reducing false indications caused by ambient light, is to limit the field of view of the photosensor. U.S. Pat. No. 4,328,488 (the "'488 patent") discloses a device which uses a lens and at least one aperture-defining member to limit the field of view for light directed to a photosensor. However, the use of the lens places strict configuration requirements on the lens, the aperture-defining member(s), photosensor and/or light guide used in the device of the '488 patent. The additional elements and the strict constraints upon the arrangement of these elements increases the complexity and expense of the device of the '488 patent.

SUMMARY OF THE INVENTION

An object of the present invention is to provide a relatively reliable light detection apparatus for detecting light from a light source.

Another object of the present invention is to provide a relatively inexpensive light detection apparatus for detecting light from a light source.

Another object of the present invention is to provide a light detection apparatus with a relatively high electromagnetic interference (EMI) noise immunity.

Another object of the present invention is to provide a relatively stable, long-life light detection apparatus.

Another object of the present invention is to provide a light detection apparatus for detecting light emitted from a combustion process.

The above and other objects are obtained by the apparatus and method herein disclosed. The light detection apparatus includes a light detector with a selective viewport. The selective viewport includes an elongated, hollow member preferably fitted with annular light traps toward one end of the member. The member and/or the light traps define a selective field of view for viewing a limited area in which light of interest is expected to exist. Thus, ambient light that is not of interest, is advantageously restricted from entering the member.

At the other end, the member has a seal with an aperture with a diameter sufficient to receive a photodiode (or other photoelectric converter) or an end of an optical fiber (or other light guide), so that the photodiode or optical fiber is fixed in a position to receive light of interest passing through the selective viewport. If the optical fiber is used, the photodiode is arranged in proximity to the end of the optical fiber not fixed in the member, to receive light from this other end of the optical fiber. The optical fiber makes possible the location of the photodiode relatively far from the light source. Because photodiodes have temperature-dependent characteristics, how remotely the photodiode is located from a light source generating appreciable heat, such as a combustion process, is an important consideration in the design of a photoelectric detector. The optical fiber can be advantageously used in the subject invention to achieve sensing of light sources generating significant heat.

Preferably, the member is aligned and fixed in a position with a bracket or flange attached to a fixed object, so that the member views the light source with a downward tilt. This downward tilt helps to reduce the amount of dust or other particles that can enter the selective viewport, thus helping to ensure low-maintenance, long-life for the light detection apparatus of the subject invention.

Whether the optical fiber is used or dispensed with in the light detector of the present invention, the light detector includes a photodiode (or other photoelectric converter) which generates a current signal based on light received through the selective viewport. The photodiode is coupled to a current amplifier that generates an amplified current signal based on the current signal received from the photodiode. Importantly, the current amplifier uses current-mode amplification providing relatively high electromagnetic interference (EMI) noise immunity relative to voltage-mode amplification. Also, the current amplifier has a relatively low input impedance that also helps to reduce susceptibility of the present invention to adverse effects from EMI.

The current amplifier is coupled to a current-sensitive switch that receives the amplified current signal and generates an electric output signal based on this amplified current signal. The switch has an adjustable switch level so that the amount of light needed to switch the logic level or state of the output signal, can be adjusted. Also, the logic levels of the output signal can be adjusted to be compatible with different logic families such as TTL, CMOS or ECL, for example.

These together with other objects and advantages, which will become subsequently apparent, reside in the details of construction and operation as more fully hereinafter described and claimed, reference being had to the accompanying drawings, forming a part hereof, wherein like numerals refer to like parts throughout.

BRIEF DESCRIPTION OF THE DRAWINGS

The present invention can be better understood with reference to the following drawings. The drawings are not necessarily to scale, emphasis instead being placed upon clearly illustrating principles of the present invention.

DETAILED DESCRIPTION OF THE PREFERRED EMBODIMENTS

Figure 1:
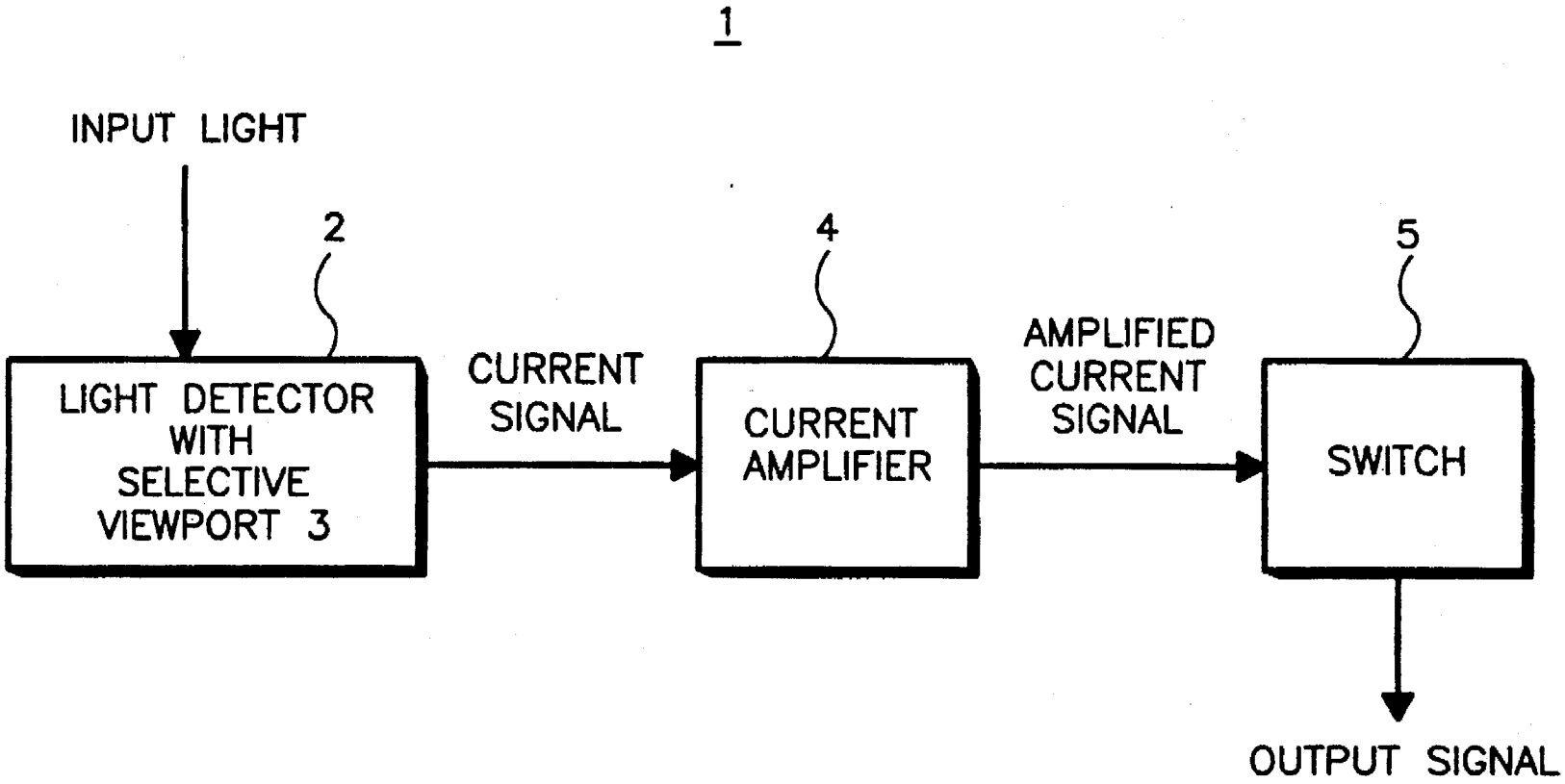
FIG. 1 is a block diagram of the present invention.

In FIG. 1, the light detection apparatus 1 of the present invention includes a light detector 2 with selective viewport 3, a current amplifier 4 and switch 5. Input light generated by a light source (not shown in FIG. 1) is received by the light detector 2. For example, the input light can be emitted from a combustion process such as that used in a gas furnace, although the light detector 2 can be used with other light sources.

The light detector 2 has a selective viewport 3 to limit the field of view of the light detector 2 so that ambient light from directions not within the field of view are excluded from the selective viewport 3. By limiting the field of view, ambient light is less likely to adversely affect light detection by the light detector 2. Based on at least part of the light received through the selective viewport 3, the light detector 2 generates a current signal. The current amplifier 4 is coupled to the light detector 2, to receive the current signal. The current amplifier 4 receives the current signal as an input, and generates an amplified current signal based on the current signal. Because the current amplifier 3 operates in a current-mode, the light detection apparatus 1 is less subject to electromagnetic interference (EMI) noise than would otherwise be the case. This immunity from EMI results because EMI has magnetic and electric fields, so that circuits employing primarily voltage signal processes are more likely to be affected by voltage and magnetic components of EMI, than are current signal processes. Therefore, the light detection apparatus 1 of the present invention advantageously uses current-mode operation particularly in the current amplifier 4, to reduce the susceptibility of the light detection apparatus 1 of the present invention, to EMI.

Also, the current amplifier 4 has a relatively low input impedance. Because high input impedance devices tend to act as antennas for EMI, the low input impedance of the current amplifier 4 also helps to reduce adverse affects caused by EMI in the light detection apparatus 1 of the present invention.

The switch 5 is coupled to the current amplifier 4 to receive the amplified current signal. The switch 5 generates an output signal with desired logic levels, based on the amplified current signal. The switch 5 can be designed such that the output signal is suitable for use with a processor or microcontroller, for example, using TTL, CMOS or ECL logic levels.

Also, the switch 5 has a switching level readily adjustable to determine the amount of amplified current needed for the output signal to change logic states. Specifically, by changing the value of a resistor (not shown in FIG. 1) used in the switch 5, the switch level for the amplified current signal can be varied. Therefore, the switch level can be selected to establish the requisite light intensities to be considered light-present and light-absent situations in the light detection apparatus 1 of the present invention. The light-absent situation can include a true light-absent situation in which a dark current exits because of reverse-biasing of an element such as a photodiode, in the light detector 2.

Figure 2:
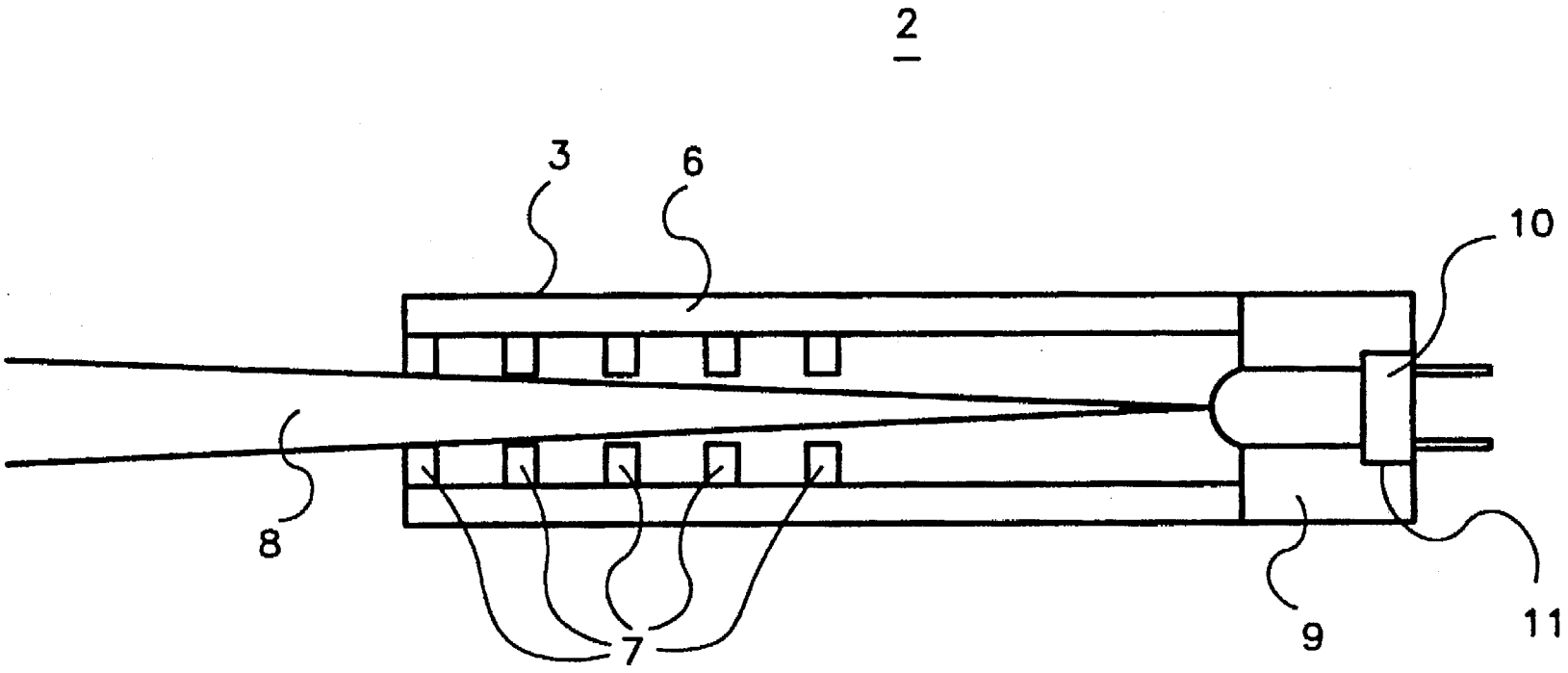
FIG. 2 is a cross-sectional diagram of a selective viewport in accordance with the present invention.

FIG. 2 is a cross-section of the light detector 2 in accordance with a first embodiment of the present invention. The selective viewport 3 includes an elongated, hollow member 6. The elongated, hollow member 6 can be a plastic or metal tube, for example, which has surfaces that are opaque to the light to be detected. Preferably, the inside of the member 6 has a coating of light-absorbing material (e.g., non-reflective black paint) or is itself light-absorbing. Light traps 7 are arranged inside the member 6. The light traps 7 are also opaque to the light of interest, and preferably either have a coating of light-absorbing material or are themselves light-absorbing. For example, the light trap 7 could be opaque, metal or plastic annular rings. The light traps 7 have apertures which are aligned along the longitudinal or elongated axis of the member 6 (i.e., in the direction from the lefthand side to the righthand side in FIG. 2), so that light from a light source from directions other than those included in the field of view 8, are stopped by the member 6 or the light traps 7. The light traps 7 can have the same size apertures, or apertures which gradually decrease in diameter from the lefthand side to the righthand side in FIG. 2, but the apertures must have sufficient diameter to avoid impeding the light in the field of view 8. At the righthand side of the member 6 in FIG. 2, a seal 9 is disposed. The seal 9 is opaque to light of interest, and can be a separate element adhered or fitted to the member 6, or an element formed integrally with the member 6. The seal 9 includes an aperture in which is fitted a photodiode 10. The seal 9 thus fixes the photodiode 10 in a position to receive light within the field of view 8 of the selective viewport 3. Many commercially available photodiodes have flanges formed at the end in which the anode and cathode leads are fixed, as shown in FIG. 2. The flange on such photodiodes can be advantageously used by forming an annular recess 11 in the seal 9, to fit and mount the flange of the photodiode 10 therein with an adhesive, for example.

As noted above, in the first embodiment of the present invention, the photodiode 10 is fitted in the seal 9, as shown in FIG. 2. The second embodiment of the present invention is similar to the first embodiment shown in FIG. 2, except that the photodiode 10 is replaced with one end of a light guide 16 such as an optical fiber, which is fixed in the seal 9. In the second embodiment of the present invention using the light guide 16, the seal 9 can include or dispense with annular recess 11. The main objective is to secure the light guide 16 or photodiode 10 (depending on whether the first or second embodiment is used) in the seal 9 so that the selective viewport 3 is light-tight to light from directions other than those within the field of view 8.

Figure 3:
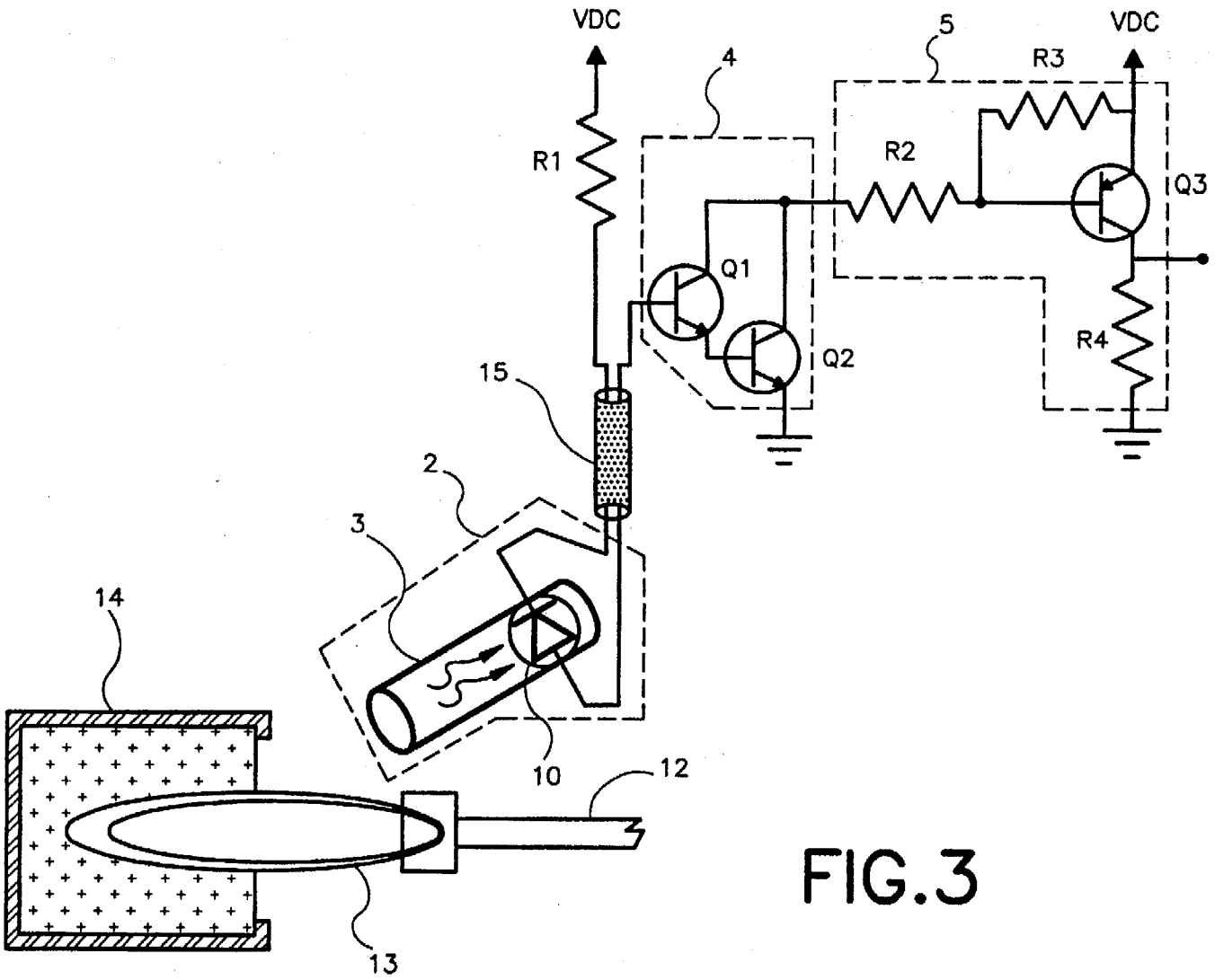
FIG. 3 is a circuit diagram of a first embodiment of the present invention.

FIG. 3 is a circuit diagram of a first embodiment of the present invention. In FIG. 3, the selective viewport 3 is aligned to view a light source 13. The light source 13 is a gas flame from a combustion process in a furnace in FIG. 13. However, the present invention could be applied to detect other light sources than the flame of a gas combustion process.

In addition to aligning the selective viewport 3 to view a combustion area in which gas from gas pipe 12 is expected to be ignited, the selective viewport 3 can be arranged so that the background viewed by selective viewport 3, in the absence of light from the light source 13, has very little ambient light. For example, in FIG. 3, the selective viewport 3 is aligned to view the inside of the combustion chamber 14 which is non-reflective and normally dark unless lighted by the flame. Preferably, the selective viewport 3 is also aligned with a downward tilt so that dust or other particles will not enter or block the selective viewport 3. This feature is particularly important in dusty environments such as those in which gas furnaces are likely to be used. The selective viewport 3 can be fixed in the correct alignment with a bracket or flange (not shown in FIG. 3) attached to a fixed object such as, for example, the gas furnace itself.

In FIG. 3, the photodiode 10 is arranged at the righthand end of the selective viewport 3. The photodiode 10 is selected to be conductive (i.e., to generate appreciable current) at light wavelengths of interest, and ideally, is selected to be non-conductive at light wavelengths that are not of interest. For example, if the light source 13 is the blue flame of methane gas, the photodiode 10 should have a sensitivity spectrum including blue light wavelengths at about 341 nm. In general, the photodiode 10 should be selected to have a sensitivity spectrum including light wavelengths of interest generated by the light source 13.

In FIG. 3, the photodiode 10 has a cathode coupled to resistor R1 and an anode coupled to the current amplifier 4. At its other end, the resistor R1 receives a first predetermined voltage level VDC with a potential level such that the photodiode 10 is reverse-biased.

In FIG. 3, the current amplifier 4 is a Darlington NPN transistor pair. Specifically, the current amplifier 4 includes a first transistor Q1 with a base coupled to the anode of the photodiode 10. The emitter of the NPN transistor Q1 is coupled to the base of an NPN transistor Q2 with an emitter coupled to a second predetermined voltage level (i.e., ground in FIG. 3). The collectors of NPN transistors Q1 and Q2 are coupled together and form the output of the current amplifier 4.

At its input, the switch 5 receives the amplified current signal from the coupled collectors of transistors Q1 and Q2, at one end of the resistor R2. The other end of the resistor R2 is coupled to the base of PNP transistor Q3. The emitter of the transistor Q3 is coupled the first predetermined voltage VDC, and a resistor R3 is coupled between the emitter and base of the transistor Q3. The collector of the transistor Q3 is coupled to one end of resistor R4 whose other end is coupled to the second predetermined voltage level (ground in FIG. 3). The output signal from the switch 5 is taken from the collector of the transistor Q3. The output signal can be provided to a processor or microcontroller (not shown), for example, to be used in control of a gas furnace or other device, depending on the application for which the present invention is to be used.

Because the light detector 2 is likely to be fixed in a location relatively remote from the other elements of the light detection apparatus 1, the cathode and anode of the photodiode 10 can be coupled to the resistor R1 and the current amplifier 4, respectively, through relatively long wire leads. If the wire leads are used, a covering 15 formed of an insulating material such as plastic, can be used to protect and insulate the wire leads from each other and other conductive objects in the environment of operation.

Figure 4:
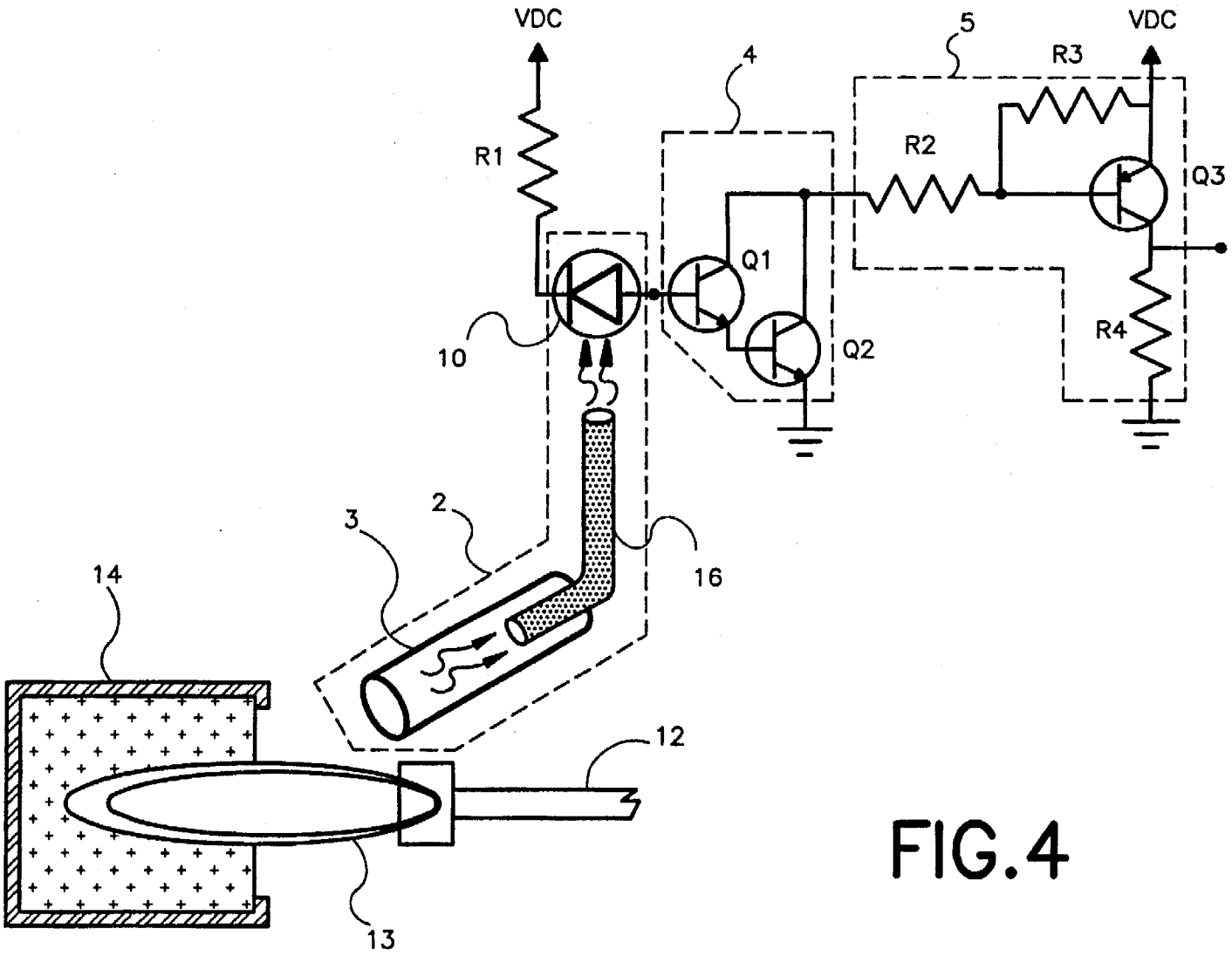
FIG. 4 is a circuit diagram of second embodiment of the present invention.

FIG. 4 is a second embodiment of the present invention. In FIG. 4, the light guide 16 such as an optical fiber, is used to guide light generated by the light source 13 to the photodiode 10. The light guide 16 is of course transmissive to wavelengths of light of interest. The use of the light guide 16 allows the photodiode 10 to be located relatively far from the light source 13. This arrangement is particularly advantageous when the light source 13 is a flame generating heat which could affect the temperature-dependent characteristics of the photodiode 10. Therefore, in the second embodiment of FIG. 4, the photodiode 10 can be located in a relatively stable temperature environment using the light guide 16, so that the photodiode 10 receives sufficient light from the light source 13 to be able to detect the presence or absence of the light. In other respects, the second embodiment of FIG. 4 is similar to the first embodiment of FIG. 3.

The application and/or environment of use of the first and second embodiments of the present invention, will dictate the characteristics, types and/or values of the elements used in FIGS. 3 and 4. The characteristics, types and/or values of these elements will depend upon the intensity of the light generated by light source 13 when the light is to be considered present or absent, the amount of ambient light, the size of the field of view 8 of the selective viewport 3, the distance of the selective viewport 3 from the light source 13, the wavelength of the light to be detected by the photodiode 10, the length of the wire leads from the photodiode 10 to the current amplifier 4 in the first embodiment of FIG. 3 and the transmissivity, loss characteristics and length of the light guide 16 in the second embodiment of FIG. 4. The characteristics, types and/or values of the elements in FIGS. 3 and 4 will also depend upon the expected temperature of operation (particularly with respect to the photodiode 10 and the transistors Q1–Q3). Therefore, the actual values of the resistors R1–R4, the characteristics of the transistors Q1–Q3, the characteristics of the photodiode 10, the length of the wire leads covered by the covering 14 in the first embodiment and the length and characteristics of the light guide 16 of the second embodiment of the present invention, can all be varied depending on the application and environment to which the subject invention is applied. However, from the circuit diagrams of FIGS. 3 and 4, those of ordinary skill in the art will be able to understand how to make a light detection apparatus 1 in accordance with the present invention.

To further enable those of ordinary skill in the art to construct the subject invention, some guidelines regarding pertinent considerations in selecting the elements used in the present invention are given as follows.

The resistor R1 should be selected such that, assuming that the photodiode 10 is a short circuit, the current flowing into the base of the transistor Q1, IBQ1=(VDC–VBEQ1–VBEQ2)/R1 (VBEQ1 and VBEQ2 being the active or saturated voltage drops across the transistors Q1 and Q2, respectively) is safely below the maximum current rating into the base of the transistor Q1. Also, under these conditions (i.e., assuming that the photodiode 10 is a short circuit), the resistor R1 should be chosen so that the current generated by the emitter of the transistor Q1 is safely below the maximum current rating into the base of the transistor Q2. The selection of the resistor R1 as explained above should allow the resistor R1 to effectively protect the photodiode 10 and the transistors Q1 and Q2 from overcurrent.

The upper bound for the resistor R1 should be such that no appreciable voltage drop occurs across the resistor R1 during normal operation of the photodiode 10. This criterion establishes the photodiode 10 as the primary current-limiting element in the circuit including the resistor R1, the photodiode 10 itself, and the transistors Q1 and Q2.

With the photodiode 10 subjected to dark conditions at an elevated temperature, the amount of current drawn by the transistors Q1 and Q2, can be measured. Because the resistor R3 is clamped across the emitter-base junction of the transistor Q3, the resistor R3 should be chosen such that the voltage drop across the resistor R3 caused by the current drawn by the transistors Q1 and Q2 under dark, elevated temperature conditions, will be significantly less than the emitter-base junction voltage when the transistor Q3 is active or saturated. As an example, the emitter-base voltage VBEQ3 will typically be about 0.7 volts when the transistor Q3 is active or saturated, so the resistor R3 should be less than one-half or one-third, for example, of 0.7 volts divided by the current drawn through the resistor R3 under the dark, elevated temperature conditions.

The resistor R3 can be used to set the switch level for the light detection apparatus 1 of the present invention. In other words, the resistor R3 determines the switching point or level at which the transistor Q3 will become active, specifically, when the amount of current drawn through the resistor R3 is sufficient to bring the voltage drop across the resistor R3, to about 0.7 volts (i.e., the active or saturated voltage drop across the emitter-base junction of the PNP transistor Q3). Because the amount of current drawn through the resistor R3 is approximately proportional to the amount of light received by the photodiode 10, the resistor R3 determines a switch level for the amount of light received by the light detector 2, above which the transistor Q3 is active and below which the transistor Q3 is cut-off. Thus, the resistor R3 also determines a switch level for the light-present and light-absent situations. To make convenient adjustment of the resistance of the resistor R3, a potentiometer can be used for the resistor R3 (actually, if desired, a potentiometer can be used for any of the resistors R1–R4).

The resistor R2 is chosen to limit to safe levels the base current in the transistor Q3. The current flowing through the resistor R2 is equal to the sum of the current flowing through the resistor R3 and the current flowing from the base of the transistor Q3. The resistor R2 should be chosen so that the current flowing through the resistor R2 is safely below the maximum base current rating for the transistor Q3 plus the current flowing through the resistor R3.

The selection of the value for the resistor R4 depends upon the voltage levels desired to represent the presence and absence of light from the light source 13. To obtain appropriate digital logic levels for the output signal, the minimum amount of light desired to be considered a light-present situation can be applied, and the value of R4 adjusted until the output has a high logic level. The resulting value for the resistor R4 should be such that the voltage drop across the resistor R4 is a low logic level for the light-absent situation.

In operation, whether the first or second embodiments of the present invention are used, the selective viewport 3 is aligned and fixed to view the area in which the light source 13 is expected to exist. Preferably, the selective viewport 3 is tilted downward so that dust will not tend to fall into the selective viewport 3. Also, the selective viewport 3 preferably should be aligned so that a dark background is viewed in the absence of light of interest from the light source 13. In the second embodiment of FIG. 4, the light of interest is guided to the photodiode 10 using light guide 16. In either the first or second embodiments, the photodiode 10 has a sensitivity spectrum which includes wavelengths of the light of interest. The photodiode 10 generates a current signal when the light of interest is present, and this current signal is amplified by the current amplifier 4. The switch 5 receives that amplified current signal and switches its output to a high logic level in response to the amplified current signal. If the light of interest is not present, the photodiode 10 no longer conducts appreciably, and the current signal received by the current amplifier 4 is relatively small. Under this condition, the amplified current signal forces the output of the switch 5 to a low logic level.

Although the invention has been described with specific illustrations and embodiments, it will be clear to those of ordinary skill in the art that various modifications may be made therein without departing from the spirit and scope of the invention as outlined in the following claims. For example, the photodiode can be any photoelectric converter that generates current in dependence upon the presence or absence of light of interest. Also, other current amplifiers and switches can be used in place of the current amplifier 4 and the switch 5, as long as the essential functions (i.e., current amplification and logic level switching, respectively) of these components are preserved.

What is claimed is:

1. An apparatus for detecting light, said apparatus comprising:

a light detector having a selective viewport, generating a current signal, based on the light received through the selective viewport;

said selective viewport including an elongated hollow member having at least one light trap member disposed therein;

a current amplifier coupled to receive the current signal from the light detector, generating an amplified current signal based on the current signal;

a switch coupled to receive the amplified current signal from the current amplifier, generating an output signal based on the amplified current signal;

wherein said light trap member comprises at least one baffle disposed in said hollow member; and, wherein said at least one baffle comprises an annular member having a central opening.

2. An apparatus for detecting light, said apparatus comprising:

a light detector having a selective viewport, generating a current signal, based on the light received through the selective viewport;

said selective viewport including an elongated hollow member having at least one light trap member disposed therein;

a current amplifier coupled to receive the current signal from the light detector, generating an amplified current signal based on the current signal;

a switch coupled to receive the amplified current signal from the current amplifier, generating an output signal based on the amplified current signal;

wherein the light detector includes a photodiode mounted at a first end of the elongated, hollow member, the photodiode capable of generating the current signal based on the light received through the current signal based on the light received through a second end of the selective viewport; and, wherein the elongated, hollow member is formed to include an annular recess at the first end, the annular recess receiving the photodiode.

3. An apparatus for detecting light, said apparatus comprising:

a light detector having a selective viewport, generating a current signal, based on the light received through the selective viewport;

said selective viewport including an elongated hollow member having at least one light trap member disposed therein;

a current amplifier coupled to receive the current signal from the light detector, generating an amplified current signal based on the current signal;

a switch coupled to receive the amplified current signal from the current amplifier, generating an output signal based on the amplified current signal;

wherein the light detector includes an optical fiber having first and second ends, the first end of the optical fiber being mounted in a first end of the elongated, hollow member, and a photodiode arranged in proximity to the second end of the optical fiber, capable of generating the current signal based on the light received through a second end of the selective viewport.

4. An apparatus as claimed in claim 3, wherein said apparatus receives a predetermined voltage level, further comprising:

a resistor having a first end coupled to receive the predetermined voltage level, and a second end coupled to a first terminal of the photodiode, a second terminal of the photodiode outputting the current signal.

5. An apparatus for detecting light, said apparatus comprising:

a light detector having a selective viewport, generating a current signal, based on the light received through the selective viewport;

said selective viewport including an elongated hollow member having at least one light trap member disposed therein;

a current amplifier coupled to receive the current signal from the light detector, generating an amplified current signal based on the current signal;

a switch coupled to receive the amplified current signal from the current amplifier, generating an output signal based on the amplified current signal;

wherein the current amplifier includes a multiple transistor circuit having a high-gain configuration, and wherein said multiple transistor circuit includes a Darlington pair of transistors.

6. An apparatus as claimed in claim 5, wherein said apparatus receives a predetermined voltage level, and wherein the Darlington pair of transistors includes a first NPN transistor having a base, a collector and an emitter, the base of the first NPN transistor being coupled to receive the current signal, and a second NPN transistor having a base coupled to the emitter of the first NPN transistor, an emitter receiving the predetermined voltage level, and a collector coupled to the collector of the first NPN transistor, the amplified current signal being generated from the collectors of the first and second NPN transistors.

7. An apparatus for detecting light, said apparatus comprising:

a light detector having a selective viewport, generating a current signal, based on the light received through the selective viewport;

said selective viewport including an elongated hollow member having at least one light trap member disposed therein;

a current amplifier coupled to receive the current signal from the light detector, generating an amplified current signal based on the current signal;

a switch coupled to receive the amplified current signal from the current amplifier, generating an output signal based on the amplified current signal; and, wherein the output signal is a predetermined logic level signal.

8. An apparatus as claimed in claim 7, wherein the predetermined logic level signal includes at least one of TTL, CMOS and ECL level signals.

9. An apparatus receiving first and second predetermined voltage levels, said apparatus for detecting a light, said apparatus comprising:

a first resistor having a first end coupled to the first predetermined voltage level, and a second end;

a photodiode arranged to receive the light, having a cathode coupled to the second end of the first resistor, and an anode;

a first NPN transistor having a base coupled to the anode of the photodiode, a collector and an emitter;

a second NPN transistor having a base coupled to the emitter of the first NPN transistor, an emitter coupled to second predetermined voltage level and a collector coupled to the collector of the first NPN transistor;

a second resistor having a first end coupled to the collectors of the first and second NPN transistors, and second end;

a third resistor having a first end coupled to the second end of the second resistor, and a second end coupled to the first predetermined voltage level;

a PNP transistor having an emitter coupled to the second end of the third transistor, a base coupled to the first end of the third transistor, and a collector;

a fourth resistor having a first end couple to the collector of the PNP transistor, and a second end coupled to the second predetermined voltage level; and, an optical fiber having a first end receiving the light and a second end arranged in proximity to the photodiode, to guide the light to the photodiode.

10. An apparatus as claimed in claim 9, further comprising:

a hollow, elongated member having a first end receiving the light from a direction determined by alignment of the hollow, elongated member, and having a second end housing the first end of the optical fiber.

11. An apparatus as claimed in claim 10, wherein the hollow, elongated member includes a plurality of annular light traps arranged therein.

12. An apparatus receiving first and second predetermined voltage levels, said apparatus for detecting a light, said apparatus comprising:

a first resistor having a first end coupled to the first predetermined voltage level, and a second end;

a photodiode arranged to receive the light, having a cathode coupled to the second end of the first resistor, and an anode;

a first NPN transistor having a base coupled to the anode of the photodiode, a collector and an emitter;

a second NPN transistor having a base coupled to the emitter of the first NPN transistor, an emitter coupled to second predetermined voltage level and a collector coupled to the collector of the first NPN transistor;

a second resistor having a first end coupled to the collectors of the first and second NPN transistors, and second end;

a third resistor having a first end coupled to the second end of the second resistor, and a second end coupled to the first predetermined voltage level;

a PNP transistor having an emitter coupled to the second end of the third transistor, a base coupled to the first end of the third transistor, and a collector;

a fourth resistor having a first end couple to the collector of the PNP transistor, and a second end coupled to the second predetermined voltage level;

a hollow, elongated member having a first end receiving the light from a direction determined by alignment of the hollow, elongated member, and having a second end housing the photodiode;

a first lead coupled between the cathode of the photodiode and the second end of the first resistor;

a second lead coupled between the anode of the photodiode and the base of the first NPN transistor; and, a covering to house at least a part of the first and second leads.

13. A method comprising the steps of:

a) selectively viewing light from a light source;

b) converting at least part of the light selectively viewed in said step (a), into a current signal;

c) amplifying the current signal to generate an amplified current signal; and d) switching an output signal between first and second logic levels, based on the amplified current signal;

e) guiding the light received in the step (a), to a photodiode performing said step (b); before performing said steps (a)–(d) aligning a selective viewport for performing said step (a) so that the selective viewport is tilted downward to reduce blockage of the selective viewport by dust.

* * * * *

UNITED STATES PATENT AND TRADEMARK OFFICE

CERTIFICATE OF CORRECTION

PATENT NO. : 5,691,700

DATED : November 25, 1997

INVENTOR(S) : Phelps *et al.*

It is certified that error appears in the above-identified patent and that said Letters Patent is hereby corrected as shown below:

Cover page, the "Assignee" should be --Gas Research Institute, Chicago, Il.-- not "United Technologies Corporation, East Hartford, Conn."

Signed and Sealed this

Fourteenth Day of April, 1998

Bruce Lehman

*Attest:*

BRUCE LEHMAN

*Attesting Officer*

*Commissioner of Patents and Trademarks*